US009397437B2

(12) United States Patent
Ohnuma

(10) Patent No.: US 9,397,437 B2
(45) Date of Patent: Jul. 19, 2016

(54) CONNECTION TERMINAL

(71) Applicant: YAZAKI CORPORATION, Minato-ku, Tokyo (JP)

(72) Inventor: Kentaro Ohnuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/497,449

(22) Filed: Sep. 26, 2014

(65) Prior Publication Data

US 2015/0011117 A1 Jan. 8, 2015

Related U.S. Application Data

(63) Continuation of application No. PCT/JP2013/002004, filed on Mar. 25, 2013.

(30) Foreign Application Priority Data

Mar. 30, 2012 (JP) ..... 2012-081777

(51) Int. Cl.
*H01R 13/52* (2006.01)
*H01R 4/18* (2006.01)
*H01R 4/20* (2006.01)

(52) U.S. Cl.
CPC ..... *H01R 13/5216* (2013.01); *H01R 4/184* (2013.01); *H01R 4/185* (2013.01); *H01R 4/187* (2013.01); *H01R 4/20* (2013.01)

(58) Field of Classification Search
CPC ..... H01R 4/185; H01R 4/02; H01R 4/20; H01R 4/023; H01R 4/187
See application file for complete search history.

(56) References Cited

U.S. PATENT DOCUMENTS 2,689,337 A * 9/1954 Burtt ..... H01R 13/111 439/851
3,686,746 A 8/1972 Gwyn, Jr.
3,805,221 A * 4/1974 Kuo ..... H01R 43/058 174/84 C
4,693,688 A * 9/1987 Cembruch ..... H01R 4/64 439/101
4,717,354 A * 1/1988 McCleerey ..... H01R 4/20 439/444
5,254,022 A * 10/1993 Stuart ..... H01R 4/20 439/851
5,281,760 A * 1/1994 Kikuchi ..... H01R 11/28 174/74 R
5,522,739 A * 6/1996 Axelsson ..... H01R 4/20 439/730
5,567,187 A * 10/1996 Bellinger ..... H01R 43/05 439/866

(Continued)

FOREIGN PATENT DOCUMENTS

CN 102025091 A 4/2011
EP 2289132 A1 3/2011

(Continued)

OTHER PUBLICATIONS

The Chinese office action letter issued on Dec. 11, 2015 in the counterpart Chinese patent application.

(Continued)

*Primary Examiner* — Gary Paumen
(74) *Attorney, Agent, or Firm* — Mots Law, PLLC

(57) ABSTRACT

A connection terminal includes a terminal connection portion to be connected with a mating terminal is connected, a wire connection portion connected to the terminal connection portion and a wire, an anticorrosion material provided to cover an area in the wire connection portion where water may be poured to the wire, and an anticorrosion material holding portion provided in the wire connection portion towards the terminal connection portion.

20 Claims, 6 Drawing Sheets

(56) References Cited

U.S. PATENT DOCUMENTS

| | | | | |
|---|---|---|---|---|
| 6,726,510 | B2 * | 4/2004 | Norbert | H01R 11/12 174/135 |
| 7,029,760 | B2 * | 4/2006 | Mori | B32B 15/017 205/226 |
| 7,174,633 | B2 * | 2/2007 | Onuma | H01R 4/04 29/854 |
| 7,811,140 | B2 * | 10/2010 | Tabata | H01R 4/185 439/877 |
| 8,951,063 | B2 * | 2/2015 | Iio | H01R 13/5216 439/523 |
| 2011/0070770 | A1 | 3/2011 | Sakai | |
| 2011/0083324 | A1 * | 4/2011 | Martauz | H01R 4/185 29/863 |
| 2013/0012077 | A1 | 1/2013 | Sato et al. | |

FOREIGN PATENT DOCUMENTS

| | | | |
|---|---|---|---|
| EP | 2432078 | A2 | 3/2012 |
| JP | H10-289745 | A | 10/1998 |
| JP | 2011-065994 | A | 3/2011 |
| JP | 2012-064575 | A | 3/2012 |
| JP | 2013-505542 | A | 2/2013 |
| WO | 2009156653 | A1 | 12/2009 |
| WO | 2011-122622 | A1 | 10/2011 |
| WO | 2011125626 | A1 | 10/2011 |

OTHER PUBLICATIONS

The Japanese office action letter issued on Oct. 13, 2015 in the counterpart Japanese patent application.

* cited by examiner

CONNECTION TERMINAL

CROSS REFERENCE TO RELATED APPLICATION

This application is a Continuation of PCT Application No. PCT/JP2013/002004, filed on Mar. 25, 2013, and claims the priority of Japanese Patent Application No. 2012-081777, filed on Mar. 30, 2012, the content of both of which is incorporated herein by reference.

BACKGROUND

1. Technical Field

The present invention relates to a connection terminal including a terminal connection portion and a wire connection portion, in which a part of a wire exposed on the outside of the wire connection portion is covered with an anticorrosion material.

2. Related Art

WO 2011/125626 A1 discloses a conventional connection terminal. As illustrated in FIGS. 1 to 3, a conventional connection terminal 50 includes a terminal connection portion 51 to be connected with a mating terminal, a wire connection portion 52 connected to a wire W, and a neck portion 53 connecting the terminal connection portion 51 to the wire connection portion 52. The wire connection portion 52 includes a pair of crimping pieces 52*a*. The exposed part of a conductor 60 of the wire W and a part of an insulation sheath 61 are integrally crimped by the crimping pieces 52*a*. In the wire connection portion 52, an area where water may be poured to the wire W is covered with solder 55 as an anticorrosion material. In particular, the solder 55 is provided to cover an exposed part of the conductor 60 on an outside of the crimping pieces 52*a*, and cover a gap in a portion where the crimping pieces 52*a* face and come into contact with each other.

In the conventional connection terminal 50, it is possible to prevent pouring water to the conductor 60 even when the connection terminal 50 pours water. In particular, in a case where the conductor 60 is made of aluminum, galvanic corrosion can be prevented.

SUMMARY

The solder 55 as the anticorrosion material is provided in a manner such that solder in a molten state is applied by use of a soldering iron, or soldering paste is applied and then heated.

In the conventional connection terminal 50, the wire connection portion 52 and the terminal connection portion 51 are connected via a bottom wall. Thus, the solder 55 in the molten state tends to flow out of the connection portion 52 towards the terminal connection portion 51. If the solder 55 flows out of the connection portion 52, the amount of coating of the solder 55 on the wire connection portion 52 decreases and a water cut-off performance of the solder 55 thus decreases. The decrease of the water cut-off performance may cause a resistance increase of the wire connection portion 52 and a decrease of a wire fixing capacity.

The present invention has been made in view of the above-described conventional problem. It is an object of the present invention to provide a connection terminal capable of preventing a resistance increase of a wire connection portion and a decrease of a wire fixing capacity derived from a decrease of a water cut-off performance of an anticorrosion material.

A connection terminal according to a first aspect of the present invention includes a terminal connection portion to be connected with a mating terminal, and a wire connection portion connected to the terminal connection portion and a wire; an anticorrosion material provided to cover an area in the wire connection portion where water may penetrate be poured to the wire; and an anticorrosion material holding portion provided in the wire connection portion towards the terminal connection portion.

The anticorrosion holding portion may be formed in a manner such that a crimping piece of the wire connection portion is bent.

The anticorrosion holding portion may be a recess provided on a bottom wall of the wire connection portion.

The anticorrosion holding portion may be formed in a manner such that a bottom wall of the wire connection portion is cut and bent upward.

In accordance with the connection terminal according to the first aspect of the present invention, at the point of covering the exposed part of the wire on the outside of the wire connection portion with the anticorrosion material, the anticorrosion material holding portion prevents the anticorrosion material in the molten state from flowing towards the terminal connection portion. Therefore, it is possible to prevent a resistance increase of the wire connection portion and a decrease of a wire fixing capacity derived from a decrease of a water cut-off performance of the anticorrosion material.

DETAILED DESCRIPTION

Hereinafter, embodiments according to the present invention will be explained with reference to the drawings.

Embodiment

Figure 1:
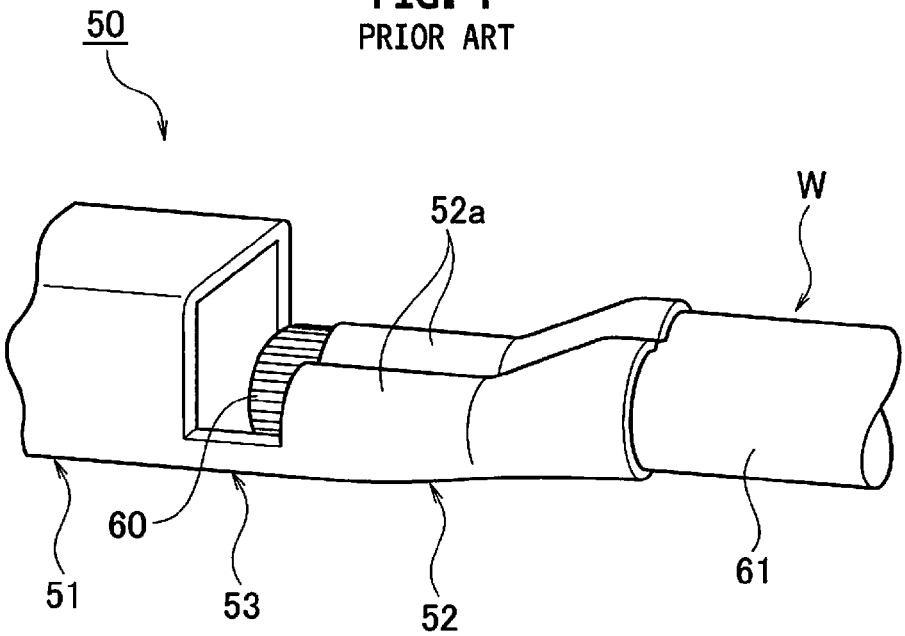
FIG. 1 PRIOR ART
FIG. 1 is a perspective view of a main part of a connection terminal according to a conventional example before solder is applied thereto.
Figure 2:
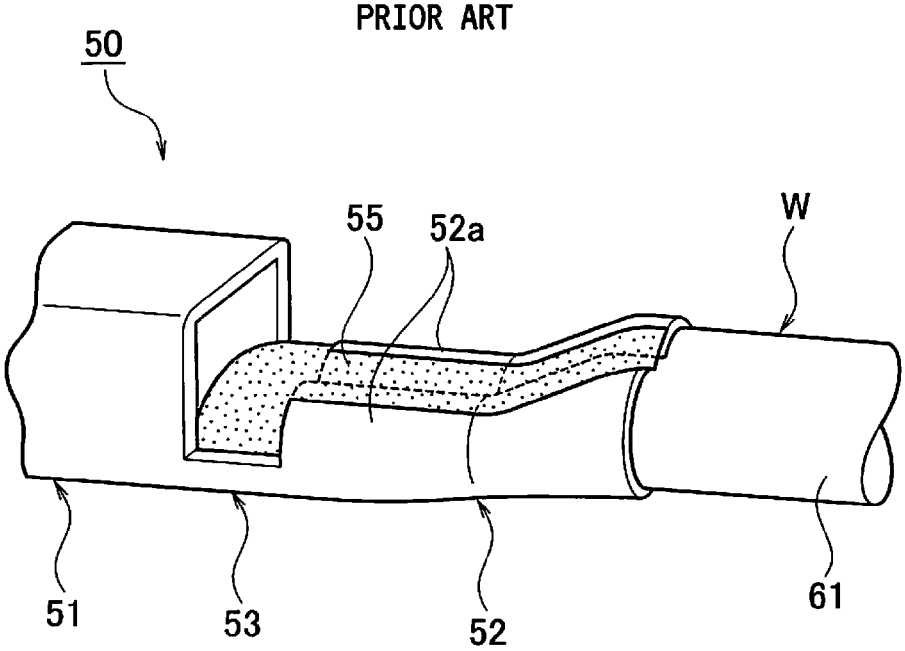
FIG. 2 PRIOR ART
FIG. 2 is a perspective view of the main part of the connection terminal according to the conventional example.
Figure 3:
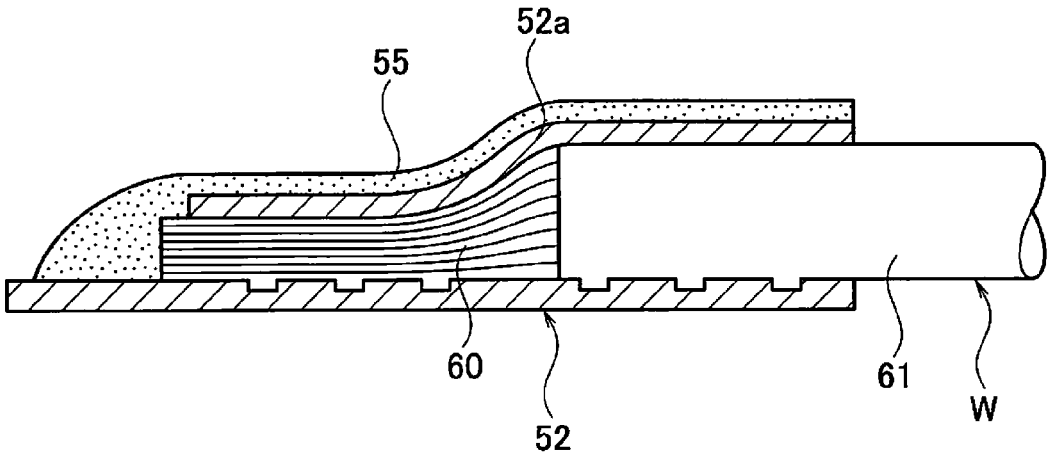
FIG. 3 PRIOR ART
FIG. 3 is a cross-sectional view of the main part of the connection terminal according to the conventional example.
Figure 4:
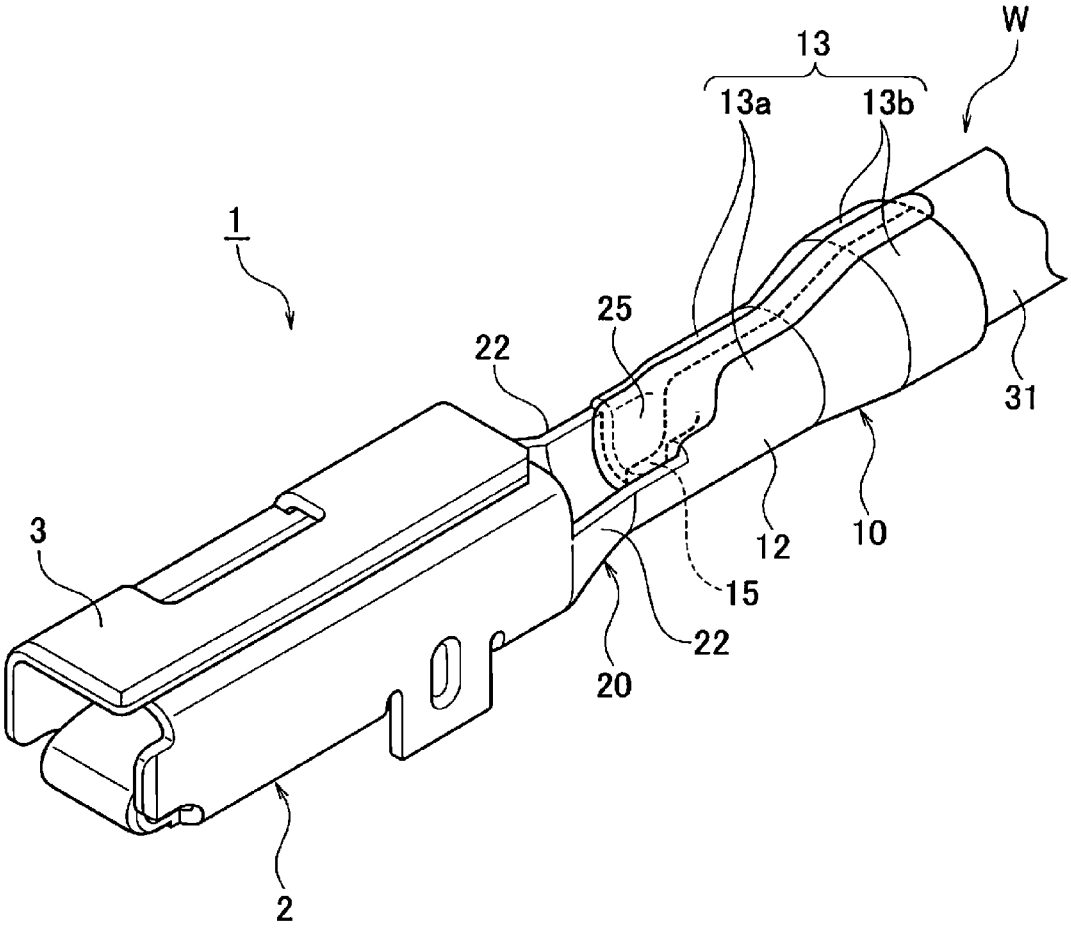
FIG. 4 is a perspective view of a connection terminal according to an embodiment.
Figure 5A:
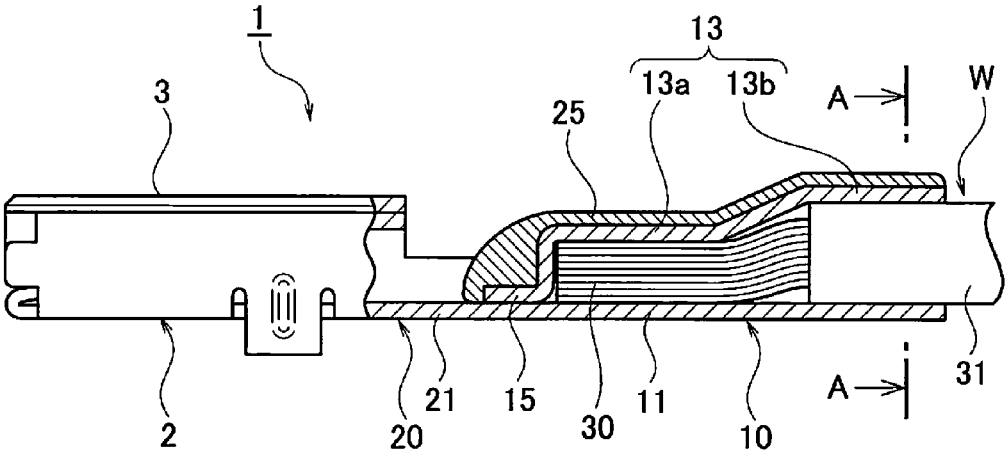
FIG. 5A is a cross-sectional view of the connection terminal according to the embodiment.
Figure 5B:
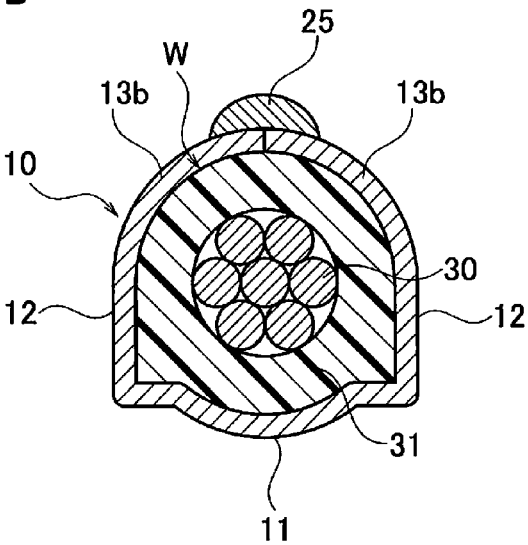
FIG. 5B is a cross-sectional view along the line A-A in FIG. 5A.
Figure 6A:
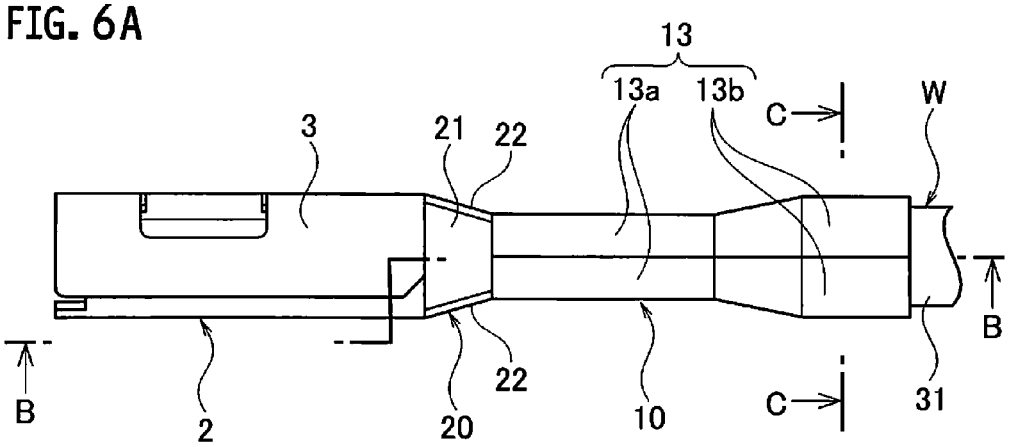
FIG. 6A is a plan view of the connection terminal according to the embodiment before solder is applied thereto.
Figure 6B:
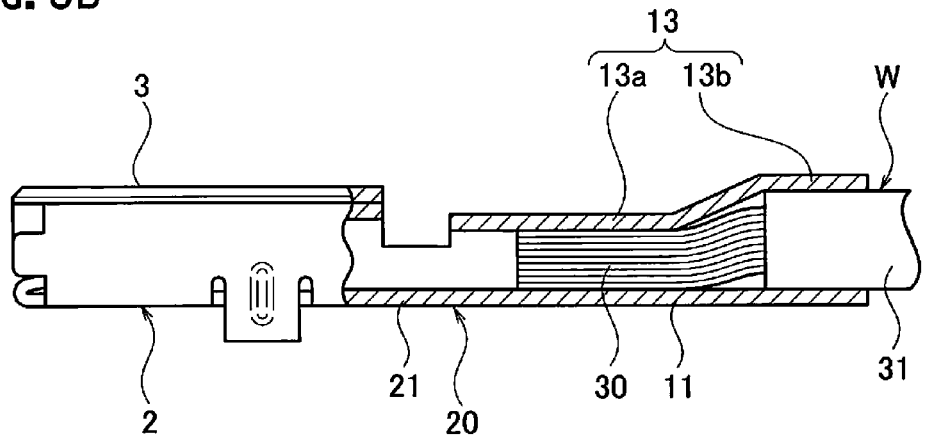
FIG. 6B is a cross-sectional view along the line B-B in FIG. 6A.
Figure 6C:
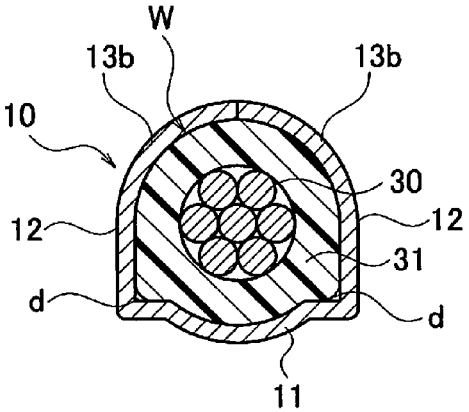
FIG. 6C is a cross-sectional view along the line C-C in FIG. 6A.

FIGS. 4 to 6 illustrate an embodiment of the present invention. A connection terminal 1 according to the embodiment includes a terminal connection portion 2 to be connected with a mating terminal (not illustrated), a wire connection portion 10 connected to a wire W, and a neck portion 20 connecting the terminal connection portion 2 to the wire connection portion 10. The terminal connection portion 2, the wire connection portion 10, and the neck portion 20 are formed in a manner such that a conductive metal plate made of a copper alloy having a predetermined shape is bent.

The terminal connection portion 2 includes a square cylindrical portion 3, and an elastic contact piece (not illustrated) disposed inside the cylindrical portion 3. When the mating terminal is inserted into the cylindrical portion 3, the mating terminal comes into close contact with the cylindrical portion 3 by an elastic restoring force of the elastic contact piece. As a result, the mating terminal is electrically connected to the terminal connection portion 2.

The wire connection portion 10 includes a wire connection portion bottom wall 11, a pair of wire connection portion side walls 12 extending from both side edges of the wire connection portion bottom wall 11, and a pair of crimping pieces 13 further extending from the respective wire connection portion side walls 12.

Each of the crimping pieces 13 includes a conductor crimping portion 13*a* located towards a front side, and a sheath crimping portion 13*b* connected to the conductor crimping portion 13*a* and located towards a rear side. In each of the crimping pieces 13, an extending height of the sheath crimping portion 13*b* is higher than that of the conductor crimping portion 13*a*. The crimping pieces 13 hold a conductor 30 of the wire W, which is made of aluminum or aluminum alloy, by crimping the conductor crimping portions 13*a*, and hold an insulation sheath 31 of the wire W by crimping the sheath crimping portions 13*b*. Namely, the conductor 30 and the insulation sheath 31 are integrally crimped by the crimping pieces 13.

The pair of the crimping pieces 13 is crimped in a manner such that each edge of the crimping pieces 13 faces and comes into contact with each other. In the insulation sheath 31, the sheath crimping portions 13*b* are crimped in a manner illustrated in FIGS. 5B and 6C.

The wire connection portion 10 is provided with an anticorrosion material holding portion 15 on the terminal connection portion 2 side. The anticorrosion material holding portion 15 is formed in a manner such that edges of the crimping pieces 13 on the terminal connection portion 2 side are bent into an L-like shape. When solder 25 in a molten state is poured into the L-like shaped space in the anticorrosion material holding portion 15, the solder 25 in the molten state is held and stored therein due to the surface tension of the solder 25.

The neck portion 20 includes a neck portion bottom wall 21, and a pair of neck portion side walls 22 elongated upward from both edges of the neck portion bottom wall 21. The neck portion bottom wall 21 and the neck portion side walls 22 are integrated with the terminal connection portion 2 and with each wall of the wire connection portion 10.

An area in the wire connection portion 10 where water may be poured the wire W, is covered with the solder 25 as an anticorrosion material. In particular, the solder 25 is provided to cover the exposed part of the conductor 30 on an outside of the crimping pieces 13, and cover a gap between the pair of the crimping pieces 13. The solder 25 may be provided in a manner such that the solder in a molten state is applied by use of a soldering iron, or soldering paste is applied and then heated.

The solder 25 in the molten state tends to flow towards the terminal connection portion 2. However, the solder 25 is stored in the anticorrosion material holding portion 15 due to the surface tension of the solder 25, and is thus prevented from flowing towards the terminal connection portion 2. Since the wire connection portion 10 is covered with a preferred amount of the solder 25, a water cut-off performance is improved. Accordingly, it is possible to prevent a resistance increase of the wire connection portion 10 and a decrease of a wire fixing capacity, each derived from a decrease of the water cut-off performance. In particular, in the case where the conductor 30 is made of aluminum or an aluminum alloy, galvanic corrosion of the conductor 30 can surely be prevented.

Once heat caused by the solder 25 in the molten state is transmitted to the insulation sheath 31, an outer surface of the insulation sheath 31 is deformed to fill gaps "d" (see FIG. 6C) present between the outer surface of the insulation sheath 31 and the inner surface of the wire connection portion 10. Such deformation can also improve the water cut-off performance and thereby prevent a resistance increase of the wire connection portion 10 and a decrease of the wire fixing capacity.

Modified Examples

Figure 7:
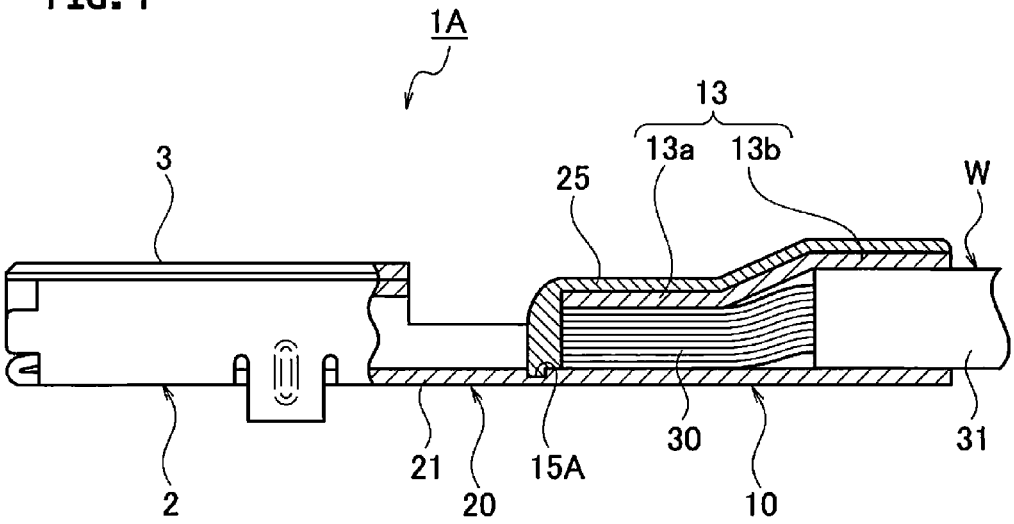
FIG. 7 is a cross-sectional view illustrating an anticorrosion material holding portion according to a first modified example of the embodiment.

As illustrated in FIG. 7, a connection terminal 1A according to a first modified example of the embodiment is provided with an anticorrosion material holding portion 15A which is a recess provided on the wire connection portion bottom wall 11. The solder 25 in the molten state, which tends to flow towards the terminal connection portion 2, is stored in and held above the anticorrosion material holding portion 15A due to the surface tension of the solder 25 and thereby prevented from flowing towards the terminal connection portion 2.

Figure 8:
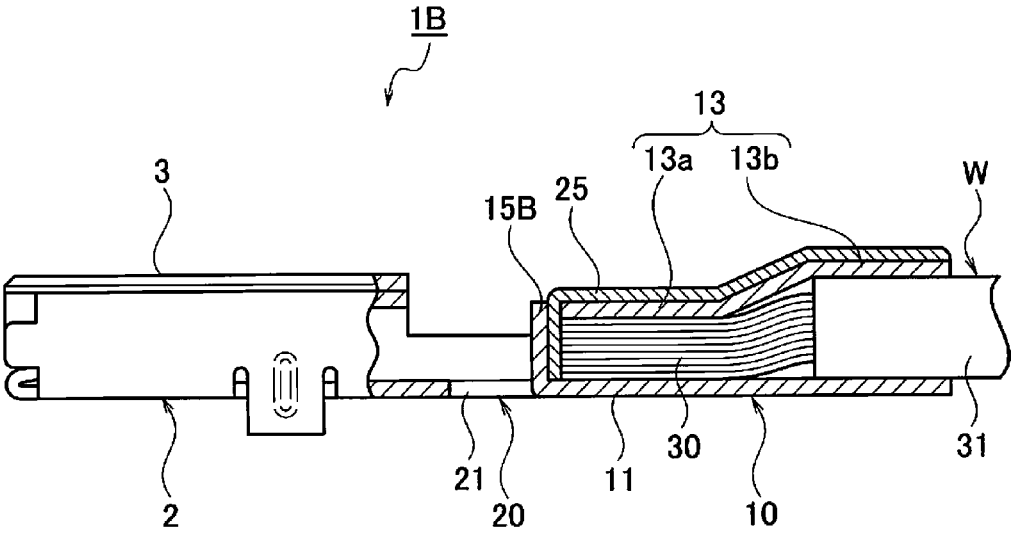
FIG. 8 is a cross-sectional view illustrating an anticorrosion material holding portion according to a second modified example of the embodiment.

As illustrated in FIG. 8, a connection terminal 1B according to a second modified example of the embodiment is provided with an anticorrosion material holding portion 15B which is formed in a manner such that the neck portion bottom wall 21 is cut and bent upward. The solder 25 in the molten state, which tends to flow towards the terminal connection portion 2, is held by and stored in the anticorrosion material holding portion 15B and thereby prevented from flowing towards the terminal connection portion 2.

The anticorrosion material holding portion is not limited to the configurations described in the embodiment, the first modified example and the second modified example as long as the anticorrosion material holding portion can hold and store the solder 25 in the molten state.

Although the solder 25 is used as the anticorrosion material in the connection terminal 1 according to the embodiment, grease, a hot-melt adhesive, or the like may be used as the anticorrosion material.

Although the conductor 30 in the connection terminal 1 according to the embodiment is made of aluminum or aluminum alloy, the conductor 30 may be made of copper or the like.

What is claimed is:

1. A connection terminal, comprising:

a wire comprising a conductor and an insulation sheath covering the conductor, one end side of the conductor exposed from the insulation sheath;

a terminal connection portion to be connected with a mating terminal;

a wire connection portion comprising a bottom wall connected to the terminal connection portion, a pair of side walls extending from both side edges of the bottom wall, and a pair of crimping pieces further extending from the respective side walls, the crimping pieces crimped to the wire;

an anticorrosion material provided to cover a gap between the crimping pieces and the exposed conductor exposed from the insulation sheath; and an anticorrosion material holding portion provided in the wire connection portion towards the terminal connection portion to hold and store the anticorrosion material in a molten state due to the surface tension of the anticorrosion material and to thereby prevent the anticorrosion material in a molten state from flowing towards the terminal connection portion.

2. The connection terminal according to claim 1, wherein the anticorrosion holding portion is formed in a manner such that each of the crimping pieces is bent towards the bottom wall into an L-like shape, and the anticorrosion material is provided to cover the gap between the anticorrosion holding portion and the exposed conductor exposed from the insulation sheath.

3. The connection terminal according to claim 1, wherein the anticorrosion holding portion is a recess provided on the bottom wall, and the anticorrosion material is stored above the anticorrosion holding portion.

4. The connection terminal according to claim 1, wherein the anticorrosion holding portion is formed in a manner such that the bottom wall is cut and bent upward, and the anticorrosion material is provided to cover the gap between the anticorrosion holding portion and the exposed conductor exposed from the insulation sheath.

5. The connection terminal according to claim 1, wherein the wire connection portion and the terminal connection portion are connected by a neck portion.

6. The connection terminal according to claim 5, wherein the terminal connection portion, the wire connection portion, and the neck portion are formed by bending a conductive metal plate made of a copper alloy having a predetermined shape.

7. The connection terminal according to claim 5, wherein the neck portion comprises a neck portion bottom wall, and a pair of neck portion side walls elongated upward from both edges of the neck portion bottom wall.

8. The connection terminal according to claim 7, wherein the anticorrosion material holding portion is formed such that the neck portion bottom wall is cut and bent upward.

9. The connection terminal according to claim 7, wherein the neck portion bottom wall and the neck portion side walls are integrated with the terminal connection portion and with each wall of the wire connection portion.

10. The connection terminal according to claim 1, wherein the terminal connection portion includes a square cylindrical portion, an elastic contact piece to be disposed inside the cylindrical portion such that a mating terminal inserted into the cylindrical portion comes into close contact with the square cylindrical portion by an elastic restoring force of the elastic contact piece and the mating terminal is electrically connected to the terminal connection portion.

11. The connection terminal according to claim 1, wherein each of the crimping pieces of the wire connection portion comprises a conductor crimping portion located towards a front side, and a sheath crimping portion connected to the conductor crimping portion and located towards a rear side.

12. The connection terminal according to claim 11, wherein an extending height of the sheath crimping portion is higher than that of the conductor crimping portion.

13. The connection terminal according to claim 11, wherein the crimping pieces crimp to and hold the conductor by crimping the conductor crimping portions, and hold the insulation sheath of the wire by crimping the sheath crimping portions such that the conductor and the insulation sheath are integrally crimped by the crimping pieces.

14. The connection terminal according to claim 1, wherein the pair of the crimping pieces is crimped such that each edge of the crimping pieces faces and comes into contact with each other.

15. The connection terminal according to claim 1, wherein the anticorrosion material holding portion is formed such that edges of the crimping pieces on the terminal connection portion side are bent to form an L-like shaped space such that anticorrosion material in the molten state poured into the L-like shaped space is held and stored in the L-like shaped space due to the surface tension of the anticorrosion material in the molten state.

16. The connection terminal according to claim 1, wherein the anticorrosion material holding portion comprises a recess provided on the bottom wall of the wire connection portion.

17. The connection terminal according to claim 16, wherein the anticorrosion material in the molten state is stored in and held above the recess due to the surface tension of the anticorrosion material in the molten state and is thereby prevented from flowing towards the terminal connection portion.

18. The connection terminal according to claim 1, wherein the anticorrosion material comprises solder.

19. The connection terminal according to claim 1, wherein the anticorrosion material comprises grease or a hot-melt adhesive.

20. The connection terminal according to claim 1, wherein the conductor is made of one of: aluminum; aluminum alloy; and copper.

* * * * *